United States Patent [19]

Intengan

[11] 4,440,301

[45] Apr. 3, 1984

[54] SELF-STACKING REAGENT SLIDE

[75] Inventor: Franklin S. Intengan, Hialeah, Fla.

[73] Assignee: American Hospital Supply Corporation, Evanston, Ill.

[21] Appl. No.: 283,841

[22] Filed: Jul. 16, 1981

[51] Int. Cl.[3] ..... B65D 85/48

[52] U.S. Cl. ..... 206/456; 206/504; 206/518; 422/57; 220/23.6

[58] Field of Search ..... 206/0.82, 454, 455, 206/456, 504, 518; 220/23.4, 23.6, 241, 242; 422/57, 65, 101; 356/244, 246; 221/226

[56] References Cited

U.S. PATENT DOCUMENTS

| | | | |
|---|---|---|---|
| 3,241,659 | 3/1966 | Segel | 206/0.82 |
| 3,424,334 | 1/1969 | Goltz | 220/23.6 |
| 3,770,383 | 11/1973 | Price | 23/253 |
| 3,796,341 | 3/1974 | Berman | 220/4 B |
| 3,864,755 | 2/1975 | Hargid | 360/133 |
| 3,899,229 | 8/1975 | Ackeret | 312/319 |
| 4,078,893 | 3/1978 | Gilman et al. | 23/253 |
| 4,087,145 | 5/1978 | Weavers | 312/319 |
| 4,131,777 | 12/1978 | Bailey et al. | 200/311 |
| 4,151,931 | 5/1979 | Scherer et al. | 221/226 |
| 4,165,573 | 8/1979 | Richards | 40/10 D |
| 4,192,562 | 3/1980 | Bishoff et al. | 312/108 |
| 4,264,560 | 4/1981 | Natelson | 356/246 |

FOREIGN PATENT DOCUMENTS

| | | | |
|---|---|---|---|
| 807586 | 7/1951 | Fed. Rep. of Germany | 206/454 |
| 890217 | 11/1943 | France | 206/454 |
| 321184 | 5/1929 | United Kingdom | 220/242 |
| 953479 | 3/1961 | United Kingdom | 206/454 |

*Primary Examiner*—William T. Dixson, Jr.
*Assistant Examiner*—David T. Fidei
*Attorney, Agent, or Firm*—Michael P. Bucklo; John H. Faro

[57] ABSTRACT

The present invention relates generally to a device for use in the analysis of fluid samples and, more particularly, to a self-stacking reagent slide which is especially useful in an automated instrument for carrying out quantitative chemical analysis of biological fluid samples.

17 Claims, 5 Drawing Figures

SELF-STACKING REAGENT SLIDE

BACKGROUND OF THE INVENTION

The use of discrete test slides of various designs in automated instruments for the chemical analysis of fluid samples, such as human blood serum, is well known. For example, such a slide is disclosed in U.S. Pat. No. 4,151,931 and the patents and applications related thereto. However, it is believed that such slide systems have drawbacks which may interfere with their efficient use in chemical analyzers.

Such known slide systems generally require that the slides be organized into stacks which are disposed in a receiving container or cartridge which is adapted to be inserted into the analyzer. The analyzer mechanism is designed to sequentially remove the slides from the stack in the cartridge and transport them through the instrument where the fluid to be tested and various reagents and the like are deposited upon a reaction area located on the slide. The reaction area of the slide may have deposited thereon, as packaged in the cartridge, a dry reagent which is appropriate for conducting a particular test in the instrument, such as the detection of digoxin concentrations in blood serum. Other cartridges would house slide stacks suitable for conducting different blood chemistry tests.

In order to keep the remaining stack of test slides organized within the cartridge when it is removed from the analyzer for overnight storage, or whenever a test requiring a different reagent than that contained on the slides in the cartridge is to be conducted with the instrument, a relatively complicated mechanical slide stack organizing system within the cartridge is required. Hence, the expense of such cartridges, which are generally not reuseable, and of their internal slide organizing mechanisms contributes significantly to the per test cost of utilizing the analyzer.

Another drawback presented by slide cartridge systems is that they may indirectly interfere with the continuous automated operation of the analyzer. The reason for this is that when more tests requiring a particular reagent are to be run with the analyzer than slides remain in the cartridge, the operation of the analyzer must be interrupted to permit a new cartridge to be inserted. This is primarily due to the fact that additional slides cannot be inserted into the cartridge. The only alternate solution to this problem is to keep count of the slides remaining in the cartridge and to use a new, full slide cartridge when the number of tests to be conducted exceeds this remaining supply of slides. However, such a procedure becomes cumbersome when the number of different tests which the instrument is capable of conducting requires that a large variety of reagent slides and accompanying cartridges be maintained.

BRIEF DESCRIPTION OF THE INVENTION

The self-stacking reagent slide of the present invention is designed to overcome the above-described drawbacks of known cartridge slide systems and provides additional manufacturing and operational advantages not possible with such systems. The present invention achieves such improvements by providing self-stacking interlocking slides which obviate the need for expensive and mechanically complex cartridges, and which permit the operator to easily observe how many reagent slides remain in the stack and add slides thereto as required by the number of tests to be conducted in the instrument.

The interlocking means of the present invention permits the slides to be snapped together, thereby simplifying their assembly for packaging after manufacture and permitting the instrument operator to add further slides to the stack when required.

Furthermore, once snapped together, the interlocking means of the present invention frictionally holds the stack of slides together and permits the movement of the slides along a single axis parallel to the plane thereof. Therefore, when so stacked, the slides will tend to remain in an organized stack until removed therefrom by the analyzer mechanism.

In addition, the reagent slide of the present invention provides a unique means for retaining reagent and a fluid sample thereon. In the preferred embodiment, this retaining means consists of a fibrous matrix which is locked in a fixed position on the slide by an insert which mechanically engages a cavity formed within the slide. This design likewise aides in the ease of manufacturing assembly of the slide of the present invention.

Further objects and advantages of the present invention will be recognized by those skilled in the art when considering the following description of the preferred embodiment taken in conjunction with the accompanying drawings.

DESCRIPTION OF THE PREFERRED EMBODIMENT

Figure 1:
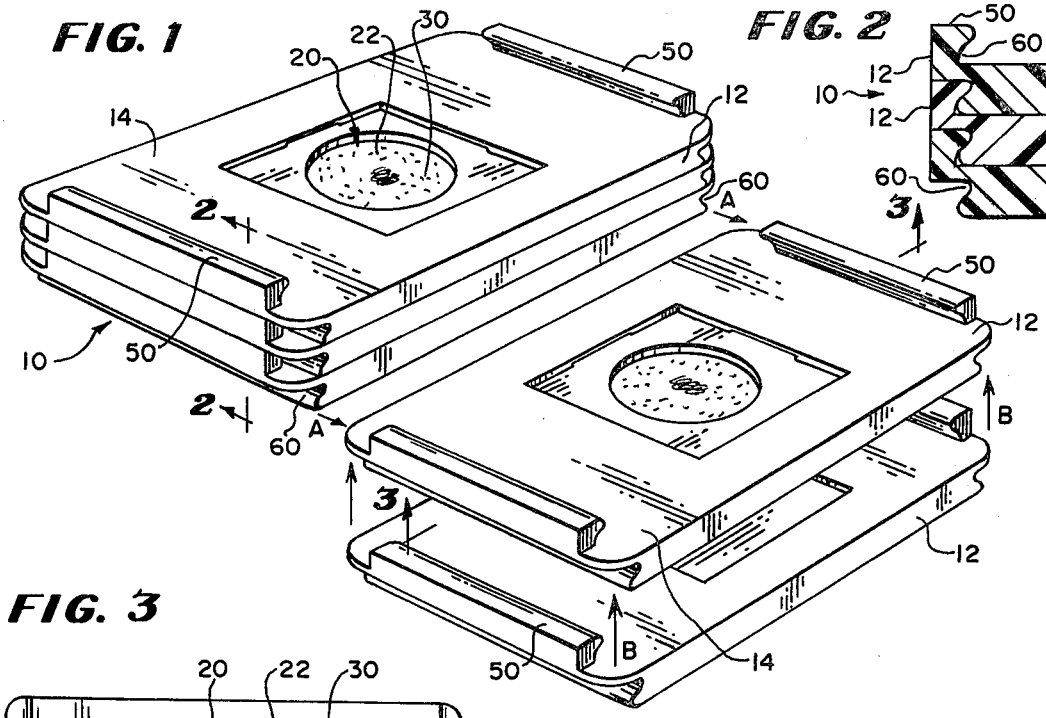
FIG. 1 is a perspective view of a stack of four reagent slides constructed in accordance with an embodiment of the present invention.
Figure 2:
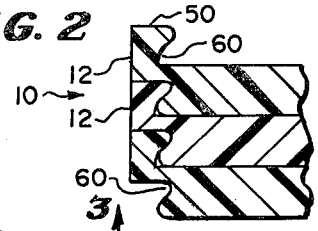
FIG. 2 is a partial side sectional view of the reagent slide stack shown in FIG. 1 taken along line 2—2 thereof.

Referring to FIGS. 1 and 2, a stack 10 of reagent slides 12 is shown, the individual slides of which are constructed in accordance with an embodiment of the present invention. The slides 12 are identically constructed as a substantially planar body 14 having a reaction area 20 located in the center thereof.

Reaction area 20 consists of an opening 22 formed through planar body 14, this opening having a porous medium 30 supported therein for retaining reagent and a fluid sample. In the preferred embodiment of the present invention, porous medium 30 is a fibrous sheet of glass microfiber paper 32, although any means for retaining reagent and a fluid sample may be utilized depending upon the requirements of the chemistries utilized in the automated instrument. However, it has been found that glass microfiber paper is particularly useful for retaining a deposit of dried reagent thereon and for promoting the even spreading of a small amount of fluid sample (for example, 20 $\mu$l) deposited thereon by the instrument during the testing sequence without causing any stretch in the fiber paper. It is important that such stretch of the fiber paper be avoided, since automated instruments of this type commonly utilize highly sensitive optical systems for reading the chemical reaction on the fiber paper which require that the reaction surface be maintained in a fixed plane.

Figure 3:
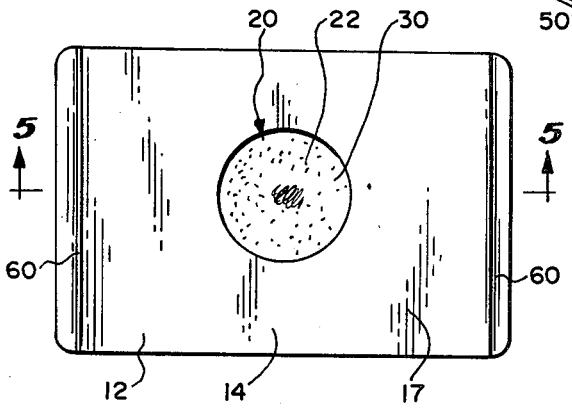
FIG. 3 is a bottom plan view of one of the reagent slides shown in FIG. 1, taken along line 3—3 thereof.
Figure 4:
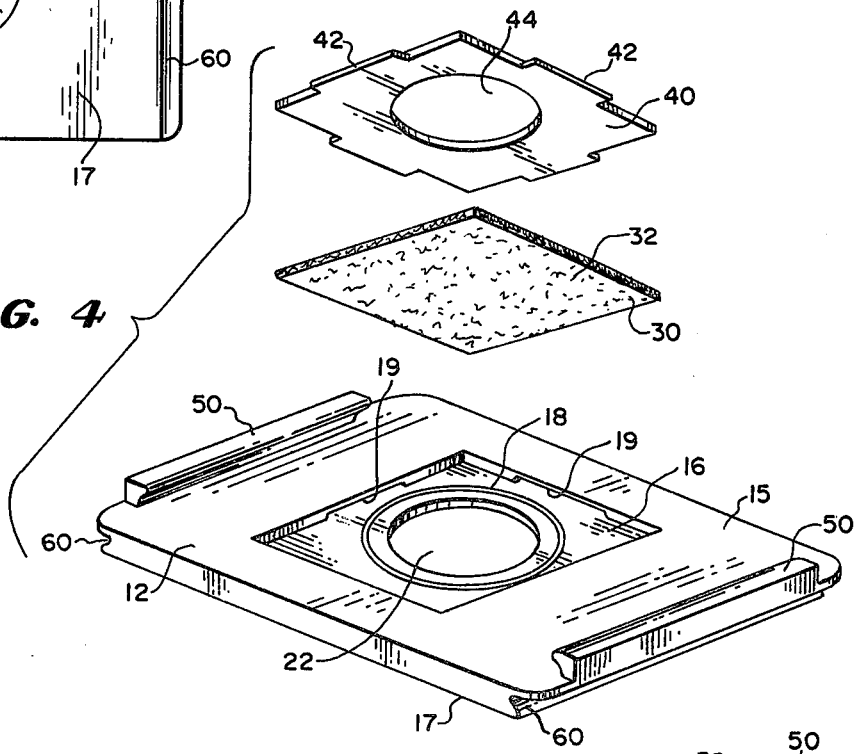
FIG. 4 is an exploded perspective view of one of the reagent slides shown in FIG. 1, illustrating the assembly of the reagent and fluid sample retaining means.
Figure 5:
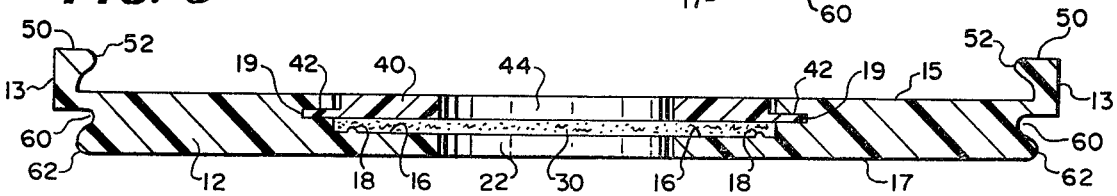
FIG. 5 is a side sectional view of the reagent slide shown in FIG. 3 taken along line 5—5 thereof.

As is best shown in FIGS. 3 through 5, fibrous sheet 32 is locked in a fixed position within reagent slide opening 22 by means of an insert 40. Such locking of the fibrous sheet 32 within reagent slide 12 is also important since any lateral shift of the fibrous sheet 32 within the reagent slide 12, once the fluid sample is deposited thereon, could also interfere with obtaining a correct reading with the instrument's optical system.

Insert 40 matingly engages a cavity 16 formed in planar body 14 of slide 12 about opening 22. As is best shown in FIG. 4, fibrous sheet 32 is positioned within cavity 16 so that it overlaps the periphery of opening 22. A circular ridge 18 is formed within cavity 16 about the periphery of opening 22 which is designed to lock fibrous sheet 32 between it and insert 40.

In the preferred embodiment, insert 40 is locked within cavity 16 by means of a snap-in mechanical engagement between lateral ribs 42 formed about the edges of insert 40 and undercut areas 19 formed about the periphery of cavity 16. In this manner, the opening 44 formed in insert 40 is brought into alignment with slide opening 22, and the manufacturing operation of mounting the insert 40 within cavity 16 is simplified in that the insert is merely mechanically engaged within cavity 16, rather than requiring an extra mounting step involving adhesives or the like. Likewise, the design of cavity 16 inherently helps to properly position fibrous sheet 32 therein during the assembly operation.

Although slide 12 of the preferred embodiment is shown having an opening 22 formed therein, and insert 40 is likewise shown having an opening 44 therein, it is noted that depending upon the requirements of the chemical reactions that take place in the slide reaction area 20 and the requirements of the instrument's optical system, either or both of these openings could be eliminated.

Turning now to the novel interlocking means which permits the reagent slides of the present invention to be self-stacking, as is best illustrated in FIGS. 1, 2 and 5, the rectangularly-shaped planar body 14 of slide 12 has a pair of ribs 50 projecting from its top face 15 and a pair of mating grooves 60 formed in its bottom face 17. Ribs 50 and grooves 60 are formed on the preferred embodiment adjacent to and along opposing edges 13 of slide 12 and form mating tongue-in-groove elements.

In order to provide the required frictional and flexing properties of the slide, planar body 14 is constructed as a one-piece element of a resilient plastic material. Likewise, it is desirable that this material be thermally resistant in order to permit the reagent deposited on fiber paper 32 to be heat-dried while it is positioned within the slide during the manufacture thereof.

As is best shown in FIG. 1, interlocking ribs 50 and grooves 60 permit the movement of slide 12 along an axis parallel to the plane of the slide planar body 14 (illustrated by arrows A) when the slide is interlocked with another such slide. Although the rib and groove design shown in the preferred embodiment would permit the slide to be moved in either direction along this axis, appropriate stops (not shown) could easily be incorporated to permit such movement in only one direction along this axis.

Furthermore, in order to permit the slides to be snapped together into their interlocked position along an axis perpendicular to the plane of planar body 14 (illustrated by arrows B), one or both of the inner edges 52 of ribs 50 and the outer edges 62 of grooves 60 may be beveled. Such beveling of these edges aids in urging the flexing of ribs 50 outward as the slides are snapped together.

Although specific embodiments of the present invention have been described above and shown in the drawings, it is to be understood that obvious variations and modifications thereof falling within the scope and spirit of the present invention may be made as required by those skilled in the art. It is therefore intended that the following claims be construed as including such variations and modifications of the present invention.

What is claimed is:

1. A self stacking reagent slide comprising a substantially planar body, having a reaction area, said reaction area being defined by an opening through said planar body and adapted for engagement of a sheet-like porous medium, said planar body being further provided with interlocking means said interlocking means comprising ribs and mating grooves arranged along an axis parallel to the plane of said planar body so as to permit the sliding engagement and disengagement of the top face of said slide with the bottom face of a slide of like construction and the sliding engagement and disengagement of the bottom face of said slide with the top face of a slide of like construction.

2. The reagent slide of claim 1 wherein said ribs project from said top face and said grooves are formed in said bottom face.

3. The reagent slide of claim 2 wherein said planar body is rectangular and said ribs and mating grooves are located adjacent to and along opposite edges of said planar body.

4. The reagent slide of claim 3 wherein said ribs and grooves are formed as mating tongue-in-groove elements.

5. The reagent slide of claim 4 wherein said ribs are formed with beveled edges so as to permit said slide to be snapped together along an axis perpendicular to the plane of said planar body into its interlocked position with another such slide.

6. The reagent slide of claim 5 wherein said grooves are also formed with beveled edges.

7. The reagent slide of claim 4 wherein said planar body and ribs are formed as a one-piece element.

8. The reagent slide of claim 7 wherein said planar body and ribs are constructed of a resilient material.

9. The reagent slide of claim 8 wherein said material is a thermally-resistant plastic.

10. The reagent slide of claim 1 wherein said opening is formed substantially in the center of said planar body.

11. The reagent slide of claim 1 wherein said porous medium is a fibrous sheet.

12. The reagent slide of claim 11 wherein said fibrous sheet is glass microfiber paper.

13. The reagent slide of claim 11 further comprising a means for locking said fibrous sheet in a fixed position within said planar body opening.

14. The reagent slide of claim 13 wherein said fibrous sheet is formed to overlap the periphery of said opening and said locking means comprises a cavity formed in said substantially planar body about said opening in which said fibrous sheet is positioned and a means for retaining said fibrous sheet within said cavity.

15. The reagent slide of claim 14 wherein said retaining means is an insert which matingly engages said cavity, said insert having an opening formed therein which is in alignment with said planar body opening when said insert is engaged within said cavity.

16. The reagent slide of claim 15 further comprising a ridge formed about the periphery of said planar body opening which locks said fibrous sheet between said planar body and said insert.

17. In a reagent slide stack adapted for use in an automated clinical analyzer typically utilizing a dispensing cartridge, so as to enable the analyzer to sequentially remove an individual slide from said stack, the improvement comprising:

a stack of reagent slides suitable for use in an automated clinical analyzer independent of a dispensing cartridge, said stack comprising (i) a plurality of reagent slides, each such slide comprising a substantially planar body having a reaction area, said reaction area defined by an opening through said planar body and adapted for engagement of a sheet-like porous medium, and (ii) interlocking means associated with each such slide, said interlocking means comprising ribs and mating grooves arranged along an axis parallel to the plane of said planar body, thereby, enabling the organized stacking of the reagent slides on top of one another by mating engagement of the ribs and grooves on one slide with the ribs and grooves of an adjacent slide and the sequential removal of an individual slide from said stack by sliding disengagement of the interlocking means of said individual slide from the stack.

* * * * *